US007168474B2

(12) United States Patent
Lam

(10) Patent No.: US 7,168,474 B2
(45) Date of Patent: Jan. 30, 2007

(54) DECORATIVE DEVICE COMPRISED OF MODULAR INTERCHANGEABLE COMPONENTS

(76) Inventor: Calvin Lam, 17745 Granada Dr., Victorville, CA (US) 92392

( * ) Notice: Subject to any disclaimer, the term of this patent is extended or adjusted under 35 U.S.C. 154(b) by 83 days.

(21) Appl. No.: 10/780,061

(22) Filed: Feb. 17, 2004

(65) Prior Publication Data

US 2004/0250500 A1 Dec. 16, 2004

Related U.S. Application Data

(60) Provisional application No. 60/448,616, filed on Feb. 19, 2003.

(51) Int. Cl.
*E04F 19/02* (2006.01)

(52) U.S. Cl. ..... 160/38; 52/312; 52/288.1

(58) Field of Classification Search ..... 160/19, 160/38, 39; 52/311.2, 312, 288.1; D6/579
See application file for complete search history.

(56) References Cited

U.S. PATENT DOCUMENTS

| | | | | | |
|---|---|---|---|---|---|
| 63,893 | A * | 4/1867 | Holmes | 52/312 |
| 332,723 | A * | 12/1885 | Mankey | 52/312 |
| 741,524 | A * | 10/1903 | Miller | 52/506.05 |
| 4,574,336 | A * | 3/1986 | Mikalonis | 362/479 |
| 4,736,559 | A * | 4/1988 | Young | 52/313 |
| 5,088,252 | A * | 2/1992 | Antekeier | 52/287.1 |
| 5,383,508 | A * | 1/1995 | Pavlica et al. | 160/38 |
| 5,444,956 | A * | 8/1995 | Searer et al. | 52/312 |
| 5,597,025 | A | 1/1997 | Forkner | |
| D411,067 | S * | 6/1999 | Cadorette | D6/579 |
| 5,927,362 | A | 7/1999 | Smiley et al. | |
| 5,967,213 | A | 10/1999 | Smiley et al. | |
| 6,082,240 | A * | 7/2000 | Middione et al. | 89/36.08 |
| 6,152,204 | A | 11/2000 | Santoro | |
| 6,173,542 | B1 * | 1/2001 | Wright | 52/211 |
| 6,341,461 | B1 * | 1/2002 | Crowley et al. | 52/311.2 |
| 6,470,639 | B1 * | 10/2002 | Horn et al. | 52/309.16 |
| 6,751,915 | B2 * | 6/2004 | Crowley | 52/311.2 |
| 6,990,776 | B2 * | 1/2006 | Berman | 52/311.1 |
| 2002/0088190 | A1 * | 7/2002 | Pacione | 52/311.2 |
| 2004/0060251 | A1 * | 4/2004 | Pamplin | 52/311.1 |
| 2004/0255542 | A1 | 12/2004 | Repp et al. | |

FOREIGN PATENT DOCUMENTS

JP 2005-230546 * 9/2005

* cited by examiner

*Primary Examiner*—Robert Canfield
(74) *Attorney, Agent, or Firm*—Kenneth L. Sherman; Myers Dawes Andras & Sherman, LLP

(57) ABSTRACT

A decorative device, such as a cornice, for crowing a variety of architectural structures also having modular and interchangeable components is disclosed. In one embodiment, a cornice comprises a horizontal base unit having a face section, a top and a bottom, and one or more interchangeable decorative modules. A decorative centerpiece for the cornice is also disclosed. Additionally, the disclosure includes novel means for attaching particular components to one another. In the preferred embodiments, the components are wood.

14 Claims, 5 Drawing Sheets

DECORATIVE DEVICE COMPRISED OF MODULAR INTERCHANGEABLE COMPONENTS

PRIORITY CLAIM

This patent application claims the benefit of the priority date of U.S. Provisional Patent Application Ser. No. 60/448,616 filed on Feb. 19, 2003 and entitled Decorative Device Comprised of Modular And Interchangeable Components pursuant to 35 USC § 119, the entire contents of this provisional patent application are hereby expressly incorporated by reference.

BACKGROUND OF THE INVENTION

1. Field of the Invention

The present invention pertains generally to the manufacture of decorative devices. More particularly, the present invention pertains to decorative products, such cornices that serve as decorative features for architectural structures. The preferred embodiment of the present invention is particularly, but not exclusively, useful as a product and a process that provides a cornice comprised of modular, interchangeable components.

2. Description of the Prior Art

Decorative devices, such cornices, that serve as ornamental features for architectural structures are well known. The devices are also utilitarian in nature in that they may serve to hide curtain rods or other structures. More specifically, cornices are ornamental moldings or projections that crown a variety of structures such as buildings, windows, drapes, walls, or paintings.

FIG. 1 illustrates a typical cornice (or valance) 2, in the prior art, from which curtains 4 are hung. As illustrated in FIGS. 2 and 3, cornice 2 is comprised of a main front decorative piece 6 and two side pieces 8, 10 that are used to couple the main piece 6 to a supporting structure such as a wall 12.

The main decorative piece 6 of cornice 2 is made from a single rigid block of material such as a wood, which is then molded or milled to a desired shape or design. The dimensions of this block must be commensurate to at least the largest dimensions used in the design of cornice 2. For example, the height of the block must be at least as high as the longest decorative height 16 of cornice 2, and its length should cover the entire length of drape 4 on wall 12, wherein decorative height 18 is the shortest height. As to the width or thickness of the block, it should be as wide as the thickest decorative design width 20 of cornice 2, as illustrated in FIG. 3, wherein design width 22 is the thinnest.

In the prior art, the process of molding singular parts from slabs of rigid material to assemble cornice has been costly and wasteful. If a singular part were damaged, the entire unit would become unusable. The block or slab dimensions of the raw work piece must have been equal to the largest dimensions of a design; with sections that are not part of the final designs milled into waste. Excess milling is a further source of waste. In addition, a cornice that is made from a single block of material is inflexible. Once a block is molded or milled to a certain design, it cannot be modified to fit another design. Instead, the entire cornice must be replaced if modification is required or desired.

In light of the above, it is an object of the present invention to provide a cornice for crowning a variety of architectural structures wherein each component of the cornice is modular and interchangeable with respect to previous subsequent components fabricated in manufacturing.

It is yet a further object of the present invention to provide a cornice and method of manufacture thereof that minimizes waste of unforged material.

It is yet still another object of the present invention to provide new and useful attachment means for individual components.

Yet another object of the present invention is to provide a cornice and process for manufacturing cornices that is relatively simple to use and comparatively cost effective.

BRIEF SUMMARY OF THE INVENTION

The present invention specifically addresses the above-mentioned objectives associated with the prior art by providing a cornice system using modular, interchangeable components. More particularly, one preferred embodiment of the present invention comprises a cornice for crowning a variety of architectural structures comprising: a horizontal base unit having a face section, a top section and a bottom section, at least one of the face section the top section and the bottom section further including connection means; and one or more decorative modules fastened to at least one of the top and bottom sections. In this preferred embodiment, all or any part of the components are manufactured from wood.

In this preferred embodiment of the present invention, each of the horizontal base units and decorative modules are modular and interchangeable components with respect to previous and subsequent components that may be fabricated. Each type of modular, interchangeable component is forged from a large block of rigid material, thereby minimizing waste of excess unforged material and thereby further minimizing waste in the event one component is forged incorrectly. In the preferred embodiments of the present invention, the rigid material is wood.

A second preferred embodiment of the present invention further includes a centerpiece module configured to fit over the face section of the modular horizontal base unit included in the first preferred embodiment. In addition, in this second preferred embodiment, the centerpiece module includes structure that has decorative features. The horizontal base unit, a particular embodiment, selectively includes one or more curved extension supports for insertion of the centerpiece module. Alternatively, one or more decorative modules may be provided which also include an insert channel for a secure insertion onto the centerpiece module.

The preferred embodiments of the present invention further include particular fasteners for components. More particularly, in a first fastener embodiment, the one or more decorative modules of the preferred embodiment may include a hollow "T" shaped channel, and the horizontal base unit includes a corresponding accommodating extension to join and secure the one or more decorative modules to the horizontal base unit. Alternatively, in a second fastener embodiment, the one or more decorative modules include a hollow inverted "L" shaped channel, and the horizontal base unit includes a corresponding accommodating extension to join and secure the one or more decorative modules to the horizontal base unit. In a third fastener embodiment, the horizontal base unit includes a hollow "T" shaped channel, and the one or more decorative modules include a corresponding accommodating extension to join and secure the one or more decorative modules to the horizontal base unit. In a fourth fastener embodiment, the horizontal base unit includes a hollow inverted "L" shaped channel, and the one or more decorative modules include a corresponding accommodating extension to join and secure the one or more decorative modules to the horizontal base unit.

In another aspect, a first preferred method of the present invention can be characterized as a method of using cornices for crowning a variety of architectural structures. This first preferred method of practicing the present invention comprises the following steps.

Obtaining a horizontal base unit, the horizontal base unit having a first mateable modular connection means.

Obtaining one of a plurality of decorative modules, the decorative module having a second mateable modular connection means.

Lastly, combining the decorative module to the horizontal base unit by connecting the first mateable modular connection means to the second mateable modular connection means to form a single cornice structure.

In another aspect, a second preferred method of the present invention can be characterized as a method of manufacturing cornices for crowning a variety of architectural structures. This second preferred method of practicing the present invention comprises the following steps.

Creating a plurality of horizontal base units, each of the horizontal base units having a first mateable modular connection means.

Creating a plurality of decorative modules, each of the decorative modules having a second mateable modular connection means.

Combining one or more decorative modules to one of the horizontal base units to form a single cornice; and Lastly, repeating the combining to form second and subsequent cornices.

In this embodiment, each of the horizontal base units and each of the decorative modules are constructed from a single block of rigid material. Further, each of the horizontal base units are interchangeable, and each of said decorative modules are interchangeable. This methodology for creating the cornices minimizes waste of excess unforged material, and further minimizes waste in the event one component is forged incorrectly.

The stated preferred methods of implementing the present invention may further include the step of forging a plurality of centerpiece modules from a respective single block of rigid material, wherein each of the centerpiece modules is interchangeable.

Additionally, stated preferred methods of implementing the present invention may also further include the step of creating connection means for connecting the horizontal base unit to the decorative module. In a first connection embodiment, this creating connection step includes the step of channeling a "T" shaped groove in the decorative module and forming a corresponding accommodating extension in the horizontal base unit for securing the decorative module to the horizontal base unit. In a second connection embodiment, this creating connection step includes the step of channeling an inverted "L" shaped groove in the decorative module and forming a corresponding accommodating extension in the horizontal base unit for securing the decorative module to the horizontal base unit. In a third connection embodiment, this creating connection step includes the step of channeling a "T" shaped groove in the horizontal base unit and forming a corresponding accommodating extension in the decorative module for securing the decorative module to the horizontal base unit. In a fourth connection embodiment, this creating connection step includes the step of channeling a "T" shaped groove in the horizontal base unit and forming a corresponding accommodating extension in the decorative module for securing the decorative module to a horizontal base unit.

Yet another preferred embodiment of the present invention may be described as a cornice for crowning a variety of architectural structures, the cornice comprising: a horizontal base unit having a face section, a top section and a bottom section; one or more decorative modules fastened to either one of, or both of, said top and bottom sections, the decorative modules including insert channels; and a center piece module configured to fit over said face of said horizontal base unit, the center piece module having portions secured by the insert channels. Alternatively, this embodiment also includes hollow "T" and "L" shaped channels and corresponding accommodating extensions for securing several components to one another.

These, as well as other advantages of the preferred embodiments and the present invention will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself and the preferred embodiments, both as to structure and operation, will be best understood from the accompanying drawings, taken in conjunction with the accompanying description, in which similar reference characters refer to similar parts, and in which.

DETAILED DESCRIPTION OF THE PREFERRED EMBODIMENTS

Figure 1:
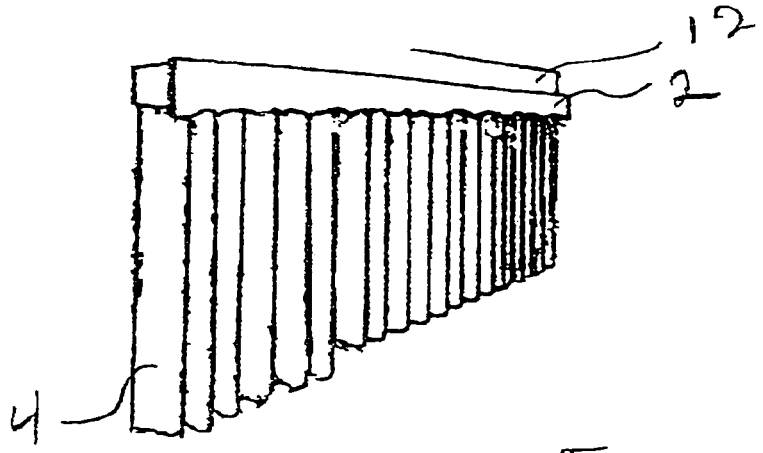
Fig. 1 (PRIOR ART)
FIG. 1 is an isometric illustration of a typical prior art cornice.
Figure 2:
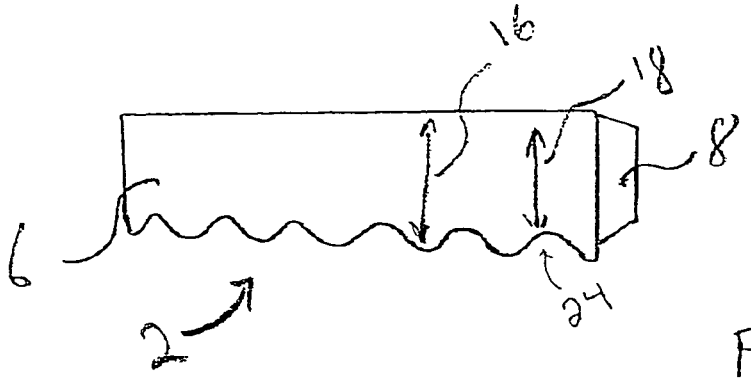
Fig. 2 (PRIOR ART)
FIG. 2 is an isometric illustration of a typical prior art cornice showing a main front decorative piece and sidepiece.
Figure 3:
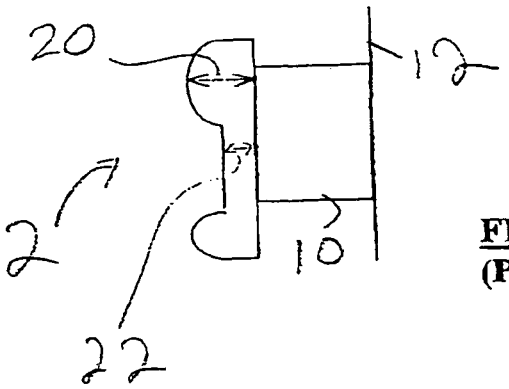
FIG. 3 (Prior Art)
FIG. 3 is a side view of a prior art cornice.
Figure 4:
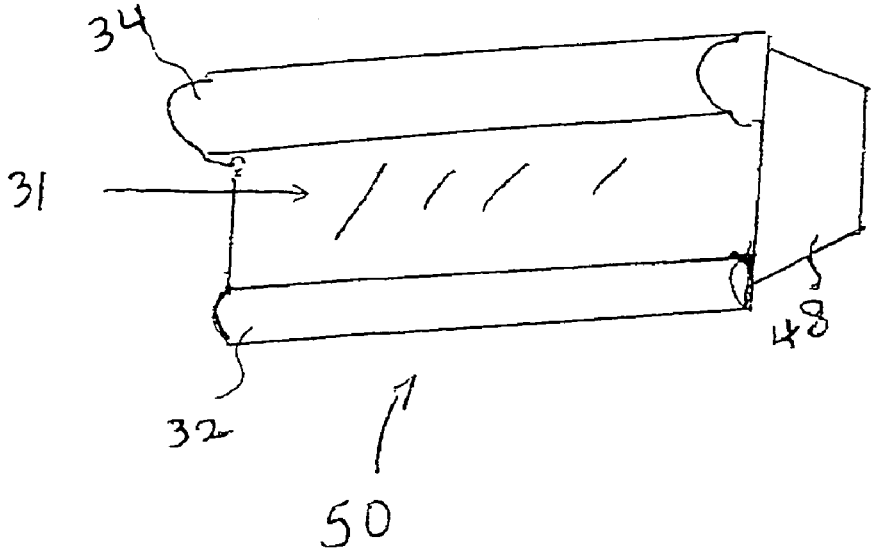
FIG. 4 is an isometric view of a cornice according to a preferred embodiment of the present invention having modular, interchangeable components.

FIG. 4 illustrates a cornice 50 according to a first preferred embodiment of the present invention, comprised of modular, interchangeable components made from separate blocks of rigid material whose dimensions are proportionate with the dimensions of each module, rather than largest dimensions of the entire cornice. In the preferred embodiment of the present invention, the rigid material is wood.

Figure 5:
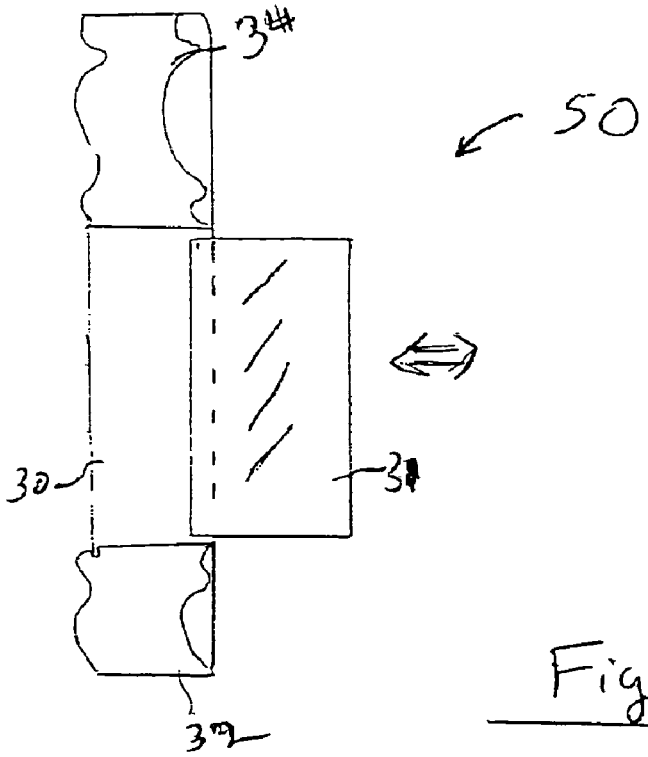
FIG. 5 is another isometric illustration of a cornice according to a preferred embodiment of the present invention showing only top and bottom modules, decorative base unit, and decorative centerpiece.

Each modular component of cornice 50 may be of any design, form, and size, and is interchangeable. The illustrated top 34 or bottom 32 decorative modules may be interchanged or be replaced by other pieces, each with different designs. The cornice 50 could have one of only a top 34, or a bottom 32 piece. Further illustrated in FIG. 4 is an insertable decorative centerpiece module 31 that can easily be replaced by another insertable module with a different design, as is illustrated in FIG. 5. The cornice 50 of FIG. 5 is comprised of differently designed top 34 and bottom 32 modules coupled to a base unit 30.

Figure 6:
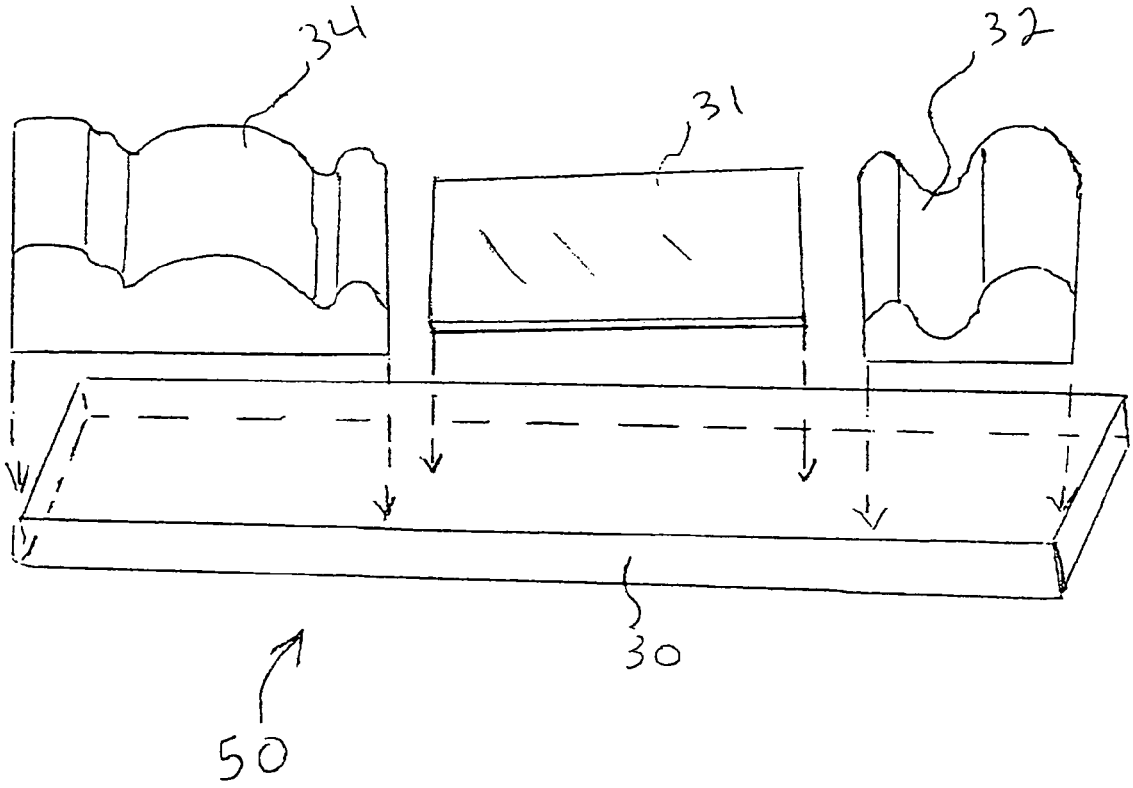
FIG. 6 is an isometric view of separate components of a cornice according to a preferred embodiment of the present invention.

FIG. 6 illustrates the separate components of cornice 50 in relation to one another. The cornice 50 includes two decorative modules 32, 34, and an insertable centerpiece module 31 that are secured (or mounted) on a base unit 30. Any size or design base unit 30, decorative modules 32, 34, or insertable centerpiece module 31 may be used. In addition, cornice 50 may be comprised of only one decorative module instead of the two that are illustrated.

Figure 7:
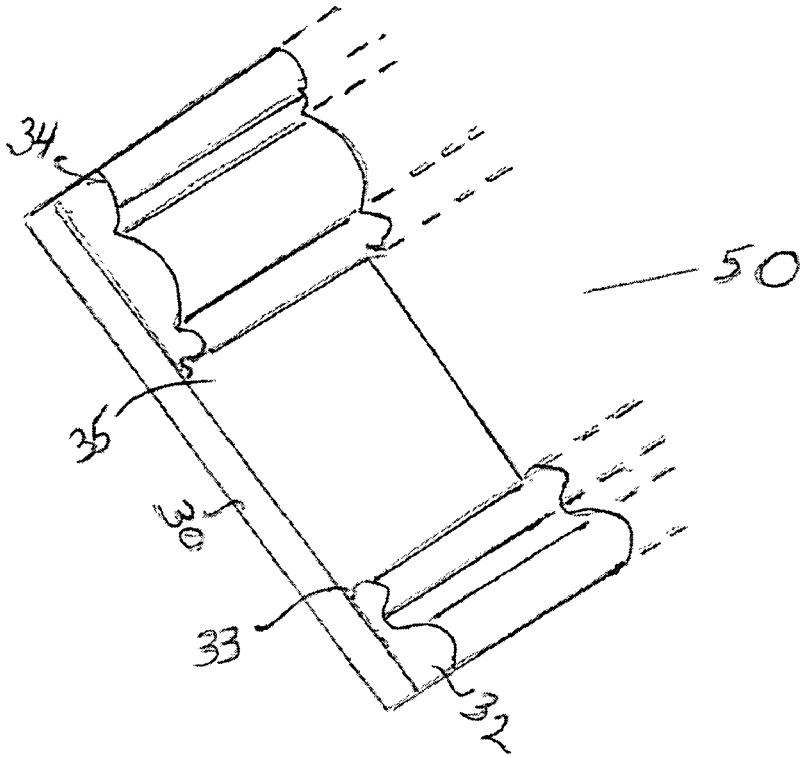
FIG. 7 is partial isometric view of a cornice according to a preferred embodiment of the present invention that has been assembled according to an exemplary embodiment.
Figure 8:
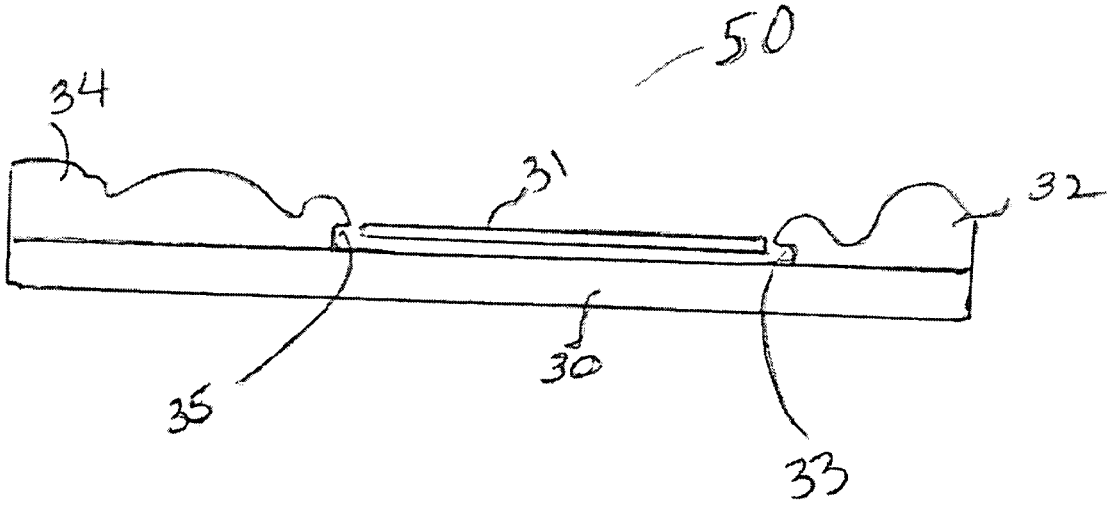
FIG. 8 is a cross sectional view taken along sectional line 8—8 of FIG. 7.

FIG. 7 illustrates a partial perspective view for cornice 50 with decorative modules 32, 34 coupled to its base unit 30 by adhesion (or some other binder). FIG. 8 further illustrates a cross sectional view taken along sectional line 8—8. FIGS. 7 and 8 illustrate the modules 32, 34 that include optional insert channels 33, 35, respectively, for a secure insertion of centerpiece module 31. The insert channels 33, 35 may be realized as concave raceways of appropriate size that extend throughout the length of each module 32 and 34 to allow center piece 31 to snugly slide onto cornice 50, covering the exposed base unit 30. The base 30, in other useful embodiments, need not extend all the way through the full height of modules 32, 34.

Figure 9A:
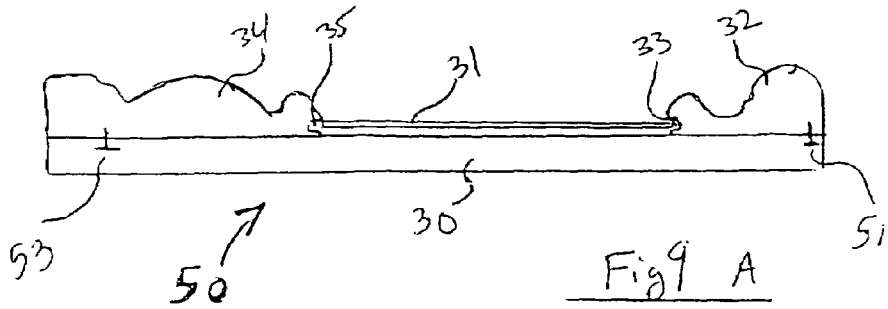
FIGS. 9A to 9D show similar cross sectional views of assembled cornices illustrating different coupling methods used within the preferred embodiments and methodologies of the present invention.
Figure 9B:
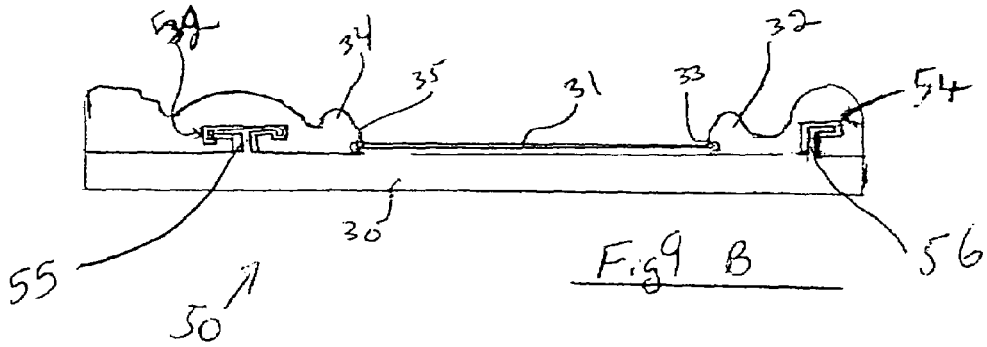
Figure 9C:
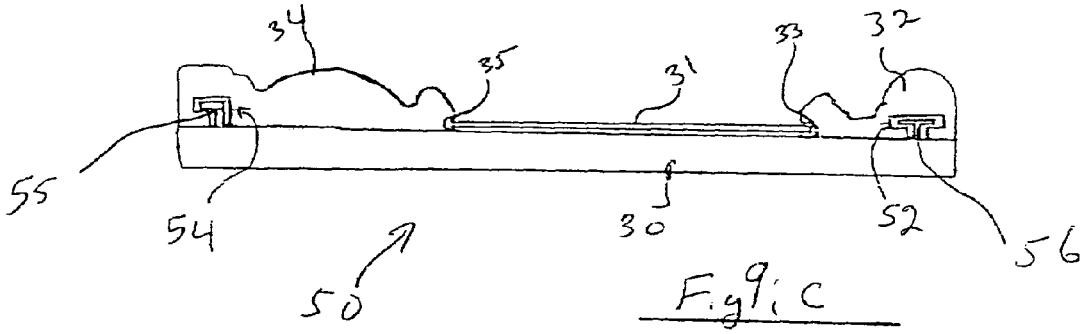

FIGS. 9A to 9D show cross sectional views of an assembled cornice 50, illustrating different coupling methods. Referring to FIG. 9A, modules 32, 34 may be mounted (or fastened) to base unit 30 through different fastener elements 51, 53, including, for example, nails or threaded fasteners such as screws. FIGS. 9B and 9C illustrate an assembled cornice 50 devoid of the use of fastener elements. In these embodiments, the bottom of the modules 32, 34 throughout their entire length include carved hollow grooves of raceways or channels 52, 54 in "T" or horizontally flipped "L" shapes. The modules 32, 34, are inserted onto the base unit 30 with similarly accommodating extensions 55, 56 for secure and tight mounting.

Figure 9D:
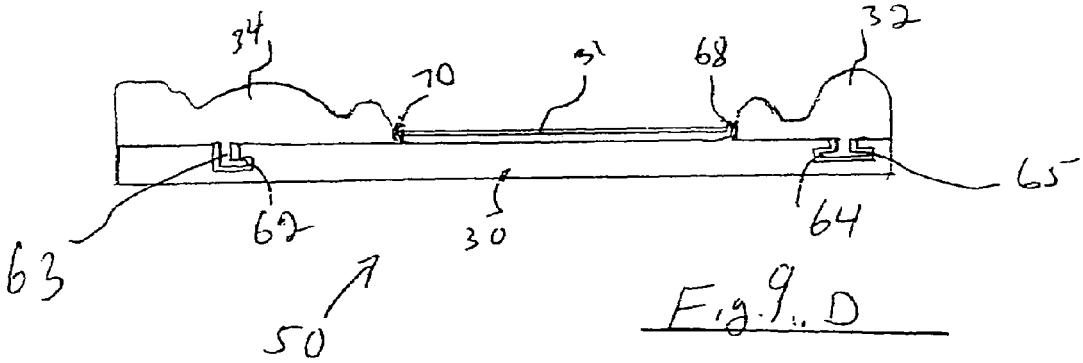

FIG. 9D illustrates the inverse structure, as compared to the previous embodiment, with respect to the modules and the base units of FIGS. 9B and 9C. In this embodiment, two sections within the top portion of the base unit 30 throughout its entire length are carved into hallow raceways or channels 62, 64 of "T" or "L" shapes. The modules 32, 34 with analogous accommodating extensions 63, 65 are securely and tightly mounted onto the base unit 30. The modules 32, 34 are mounted by inserting their extensions 63, 65 into the matching channels 62, 64. In addition, the base unit 30 further includes two curved extension supports 68, 70 similar to a hook, for insertion of a centerpiece module 3 1. With this option, alternative modules 32 or 34 need not have the optional insertion channels 33, 35.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Decorative Device Comprised of Modular And Interchangeable Components as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A cornice for crowning a variety of architectural structures comprising:

a horizontal base unit having a face section, a top section and a bottom section, at least one of the face section, top section and bottom section further including fastening means;

an interchangeable top decorative module removably coupled to the top section of the horizontal base unit;

an interchangeable bottom decorative module removably coupled to the top section of the horizontal base unit; and an interchangeable centerpiece decorative module removably coupled to the horizontal base unit and disposed over the face section of the horizontal base unit, wherein each of said decorative modules are modular and interchangeable types of components with respect to previous and subsequent components fabricated in manufacturing, and wherein each said type of component is forged from a large block of wood, wherein the modular and interchangeable types of components minimize waste of excess unforged material, and further minimize waste in the event one component is forged incorrectly, and wherein at least one of the decorative modules includes a hollow channel, and wherein the horizontal base unit includes a corresponding accommodating extension to removably mate with the hollow channel.

2. The cornice of claim 1, further comprising curved extensions supports to removably secure the interchangeable top decorative module and interchangeable bottom decorative module over said horizontal base unit.

3. The cornice of claim 1, wherein the interchangeable top decorative module and the interchangeable bottom decorative module each comprise an insert channel for a secure insertion of said centerpiece module.

4. The cornice of claim 1, wherein the hollow channel comprises a hollow "T" shaped channel, and wherein the corresponding accommodating extension of the horizontal base unit is configured to removably mate with the hollow "T" shaped channel.

5. The cornice of claim 1, wherein the hollow channel comprises a hollow inverted "L" shaped channel, and wherein the corresponding accommodating extension of the horizontal base unit is configured to removably mate with the hollow inverted "L" shaped channel.

6. A cornice for crowning a variety of architectural structures comprising:

a horizontal base unit having a face section, a top section and a bottom section, at least one of the face section, top section and bottom section further including fastening means;

an interchangeable top decorative module removably coupled to the top section of the horizontal base unit;

an interchangeable bottom decorative module removably coupled to the top section of the horizontal base unit; and an interchangeable centerpiece decorative module removably coupled to the horizontal base unit and disposed over the face section of the horizontal base unit, wherein each of said decorative modules are modular and interchangeable types of components with respect to previous and subsequent components fabricated in manufacturing, and wherein each said type of component is forged from a large block of wood, wherein the modular and interchangeable types of components minimize waste of excess unforged material, and further minimize waste in the event one component is forced incorrectly, and wherein the horizontal base unit includes a hollow channel, and wherein at least one of the decorative modules includes a corresponding accommodating extension to removably mate with the hollow channel.

7. The cornice of claim 6, wherein the hollow channel comprises a hollow inverted "L" shaped channel, and wherein the corresponding accommodating extension is configured to removably mate with the hollow inverted "L" shaped channel.

8. The cornice of claim 6, wherein the hollow channel comprises a hollow "T" shaped channel, and wherein the corresponding accommodating extension is configured to removably mate with the hollow "T" shaped channel.

9. The cornice of claim 6, further comprising curved extensions supports to removably secure the interchangeable top decorative module and interchangeable bottom decorative module over said horizontal base unit.

10. The cornice of claim 6, wherein the interchangeable top decorative module and the interchangeable bottom decorative module each comprise an insert channel for a secure insertion of said centerpiece module.

11. A cornice for crowning a variety of architectural structures comprising:

a horizontal base unit having a face section, a top section and a bottom section;

top and bottom interchangeable decorative modules removably fastened to said top and bottom sections, respectively, the top and bottom decorative modules including insert channels; and an interchangeable centerpiece module configured to fit over said face of said horizontal base unit, the centerpiece module having portions secured by the insert channels, wherein the top and bottom decorative modules each include a hollow "T" shaped channel, and wherein the horizontal base unit includes corresponding accommodating extensions to join and secure the top and bottom decorative modules to the horizontal base unit.

12. A cornice for crowning a variety of architectural structures comprising:

a horizontal base unit having a face section, a top section and a bottom section;

top and bottom interchangeable decorative modules removably fastened to said top and bottom sections, respectively, the top and bottom decorative modules including insert channels; and an interchangeable centerpiece module configured to fit over said face of said horizontal base unit, the centerpiece module having portions secured by the insert channels, wherein the top and bottom decorative modules include a hollow inverted "L" shaped channel, and wherein the horizontal base unit includes corresponding accommodating extensions to join and secure the top and bottom decorative modules to the horizontal base unit.

13. A cornice for crowning a variety of architectural structures comprising:

a horizontal base unit having a face section, a top section and a bottom section;

top and bottom interchangeable decorative modules removably fastened to said top and bottom sections, respectively, the top and bottom decorative modules including insert channels; and an interchangeable centerpiece module configured to fit over said face of said horizontal base unit, the centerpiece module having portions secured by the insert wherein the horizontal base unit includes a hollow "T" shaped channel, and wherein at least one of the decorative modules includes a corresponding accommodating extension to removably mate with the hollow "T" shaped channel.

14. A cornice for crowning a variety of architectural structures comprising:

a horizontal base unit having a face section, a top section and a bottom section;

top and bottom interchangeable decorative modules removably fastened to said top and bottom sections, respectively, the top and bottom decorative modules including insert channels; and an interchangeable centerpiece module configured to fit over said face of said horizontal base unit, the centerpiece module having portions secured by the insert channels, wherein the horizontal base unit includes a hollow inverted "L" shaped channel, and wherein at least one of the decorative modules includes a corresponding accommodating extension to removably mate with the hollow "L" shaped channel.

* * * * *